US006911952B2

(12) United States Patent
Sievenpiper et al.

(10) Patent No.: US 6,911,952 B2
(45) Date of Patent: Jun. 28, 2005

(54) CROSSED-SLOT ANTENNA FOR MOBILE SATELLITE AND TERRESTRIAL RADIO RECEPTION

(75) Inventors: Daniel F. Sievenpiper, Los Angeles, CA (US); Hui-Pin Hsu, Northridge, CA (US)

(73) Assignee: General Motors Corporation, Detroit, MI (US)

( * ) Notice: Subject to any disclaimer, the term of this patent is extended or adjusted under 35 U.S.C. 154(b) by 15 days.

(21) Appl. No.: 10/409,513

(22) Filed: Apr. 8, 2003

(65) Prior Publication Data

US 2004/0201533 A1 Oct. 14, 2004

(51) Int. Cl.[7] ..... H01Q 13/10
(52) U.S. Cl. ..... 343/770; 343/767
(58) Field of Search ..... 343/700 MS, 702, 343/767, 770, 771

(56) References Cited

U.S. PATENT DOCUMENTS 4,916,457 A * 4/1990 Foy et al. ..... 343/770
5,581,266 A * 12/1996 Peng et al. ..... 343/770
6,593,891 B2 * 7/2003 Zhang ..... 343/767
6,646,618 B2 * 11/2003 Sievenpiper ..... 343/770

OTHER PUBLICATIONS

Sievenpiper, U.S. Appl. No. 09/829,192 filed Apr. 10, 2001, "Low–Profile Slot Antenna for Vehicular Communications and Method of Making and Designing Same".

* cited by examiner

*Primary Examiner*—Tan Ho
(74) *Attorney, Agent, or Firm*—Christopher DeVries

(57) ABSTRACT

A crossed-slot antenna is fabricated using rectangular sheet of metal. A crossed-slot is etched or stamped in the sheet of metal. A feed structure is similarly formed in the sheet of metal. Sidewalls are integrally formed with the sheet of metal and are bent to form a rectangular box. A circuit board is attached to the rectangular box. An air-filled cavity is defined by the sheet of metal, the sidewalls, and the circuit board. Alternatively, a crossed-slot antenna with a solid cavity is fabricated using a sheet of plastic. Ridges are formed in a cross pattern on the sheet of plastic. The sheet of plastic is plated with metal. The metal is removed from a surface of the sheet of plastic, exposing the ridges.

41 Claims, 5 Drawing Sheets

CROSSED-SLOT ANTENNA FOR MOBILE SATELLITE AND TERRESTRIAL RADIO RECEPTION

FIELD OF THE INVENTION

The present invention relates to antennas, and more particularly to crossed-slot antennas for mobile satellite and terrestrial reception.

BACKGROUND OF THE INVENTION

Smaller, less visible antennas are an increasing trend in vehicle design. One approach for providing these antennas employs a crossed-slot antenna. The crossed-slot antenna can receive signals from satellite radio broadcasting systems such as satellite digital audio radio system (SDARS). Crossed-slot antennas can be as thin as a small fraction of one wavelength tall when combined with a resonant cavity. The reception characteristics and the relatively small size of crossed-slot antennas are ideal for mobile receiver applications.

Conventional fabrication techniques for crossed-slot antennas require the use of low-loss dielectric materials such as Teflon or Duroid. These materials may be prohibitively expensive for commercial applications such as high-volume automobile manufacturing. Absent these specialized low-loss materials, the internal dielectric loss of the crossed-slot antenna is unacceptably high.

Conventional fabrication methods for the crossed-slot antenna employ printed circuit boards. A circuit board is initially plated with a suitable metal, such as copper, which acts as the antenna. Typically, slots are made in the antenna using standard photolithography techniques. The printed circuit board is formed with a suitable dielectric material and acts as a cavity for the antenna.

SUMMARY OF THE INVENTION

A crossed-slot antenna according to the present invention is fabricated by forming a feed structure and a crossed-slot in a sheet of metal. Sidewalls are formed on the sheet of metal. The sidewalls are attached to a circuit board to form an air-filled cavity defined by the sheet of metal, the sidewalls, and the circuit board.

In another embodiment, a crossed-slot antenna with a solid cavity is fabricated. First and second intersecting ridges are created on one side of a sheet of plastic. A feed aperture is formed in the sheet of plastic. The sheet of plastic is plated with metal. The metal plating is removed from one side of the sheet of plastic to expose a first ridge and a second ridge. The sheet of plastic is attached to a circuit board.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
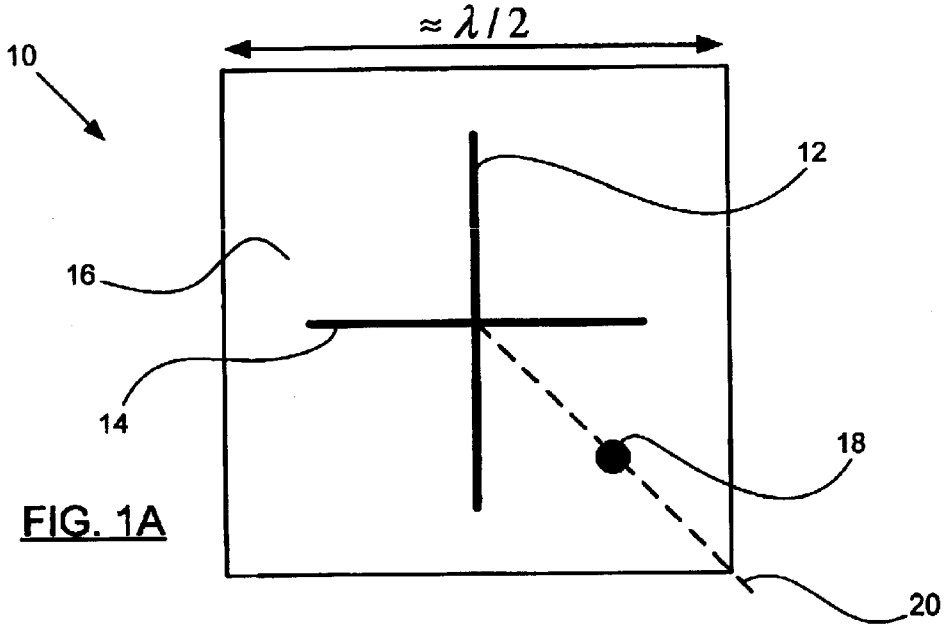
FIG. 1A is a plan view of an exemplary crossed-slot antenna according to the present invention.

The following description of the preferred embodiments is merely exemplary in nature and is in no way intended to limit the invention, its application, or uses. For purposes of clarity, the same reference numbers will be used in the drawings to identify similar elements.

Figure 1B:
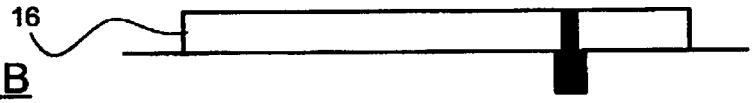
FIG. 1B is a side cross-sectional view of the exemplary crossed-slot antenna of FIG. 1A.

An exemplary crossed-slot antenna according to the present invention is shown in FIGS. 1A and 1B. The crossed-slot antenna 10 receives radio frequency (RF) waves having left hand circular polarization and RF waves having vertical linear polarization. A first slot 12 crosses a second slot 14 to form a crossed-slot pattern in an antenna plane 16. The first slot 12 is slightly detuned from the second slot 14 and has a different resonant frequency.

The crossed-slot antenna 10 is suited for satellite radio broadcasting systems such as SDARS. Satellites in satellite radio systems broadcast information to a terrestrial repeater network, which subsequently rebroadcasts the information to a mobile receiver. Satellites typically broadcast in circular polarization, wherein the orientation of the receiver is not important. Terrestrial broadcasters, however, use vertical linear polarization. The crossed-slot antenna 10 is able to receive transmissions from both satellite and terrestrial broadcasters as will be described below.

The first slot 12 is shorter than the second slot 14. Consequently, the first slot 12 has slightly higher resonant frequency than the second slot 14. An antenna feed point 18 is positioned along a line 20 lying at a forty-five degree angle between the first slot 12 and the second slot 14. The position of the feed point 18 causes the first slot 12 and the second slot 14 to be excited equally.

The antenna 10 is designed so that the first slot 12 is out of phase with the second slot 14 by approximately ninety degrees when both slots are excited simultaneously. The antenna arrangement results in circular polarization for angles near zenith and for angles within the upper hemisphere. For angles near the horizon, the effective cross section of one of the slots approaches an infinitesimal point. The resulting radiation from the opposing slot is linearly polarized in the vertical direction.

Figure 2:
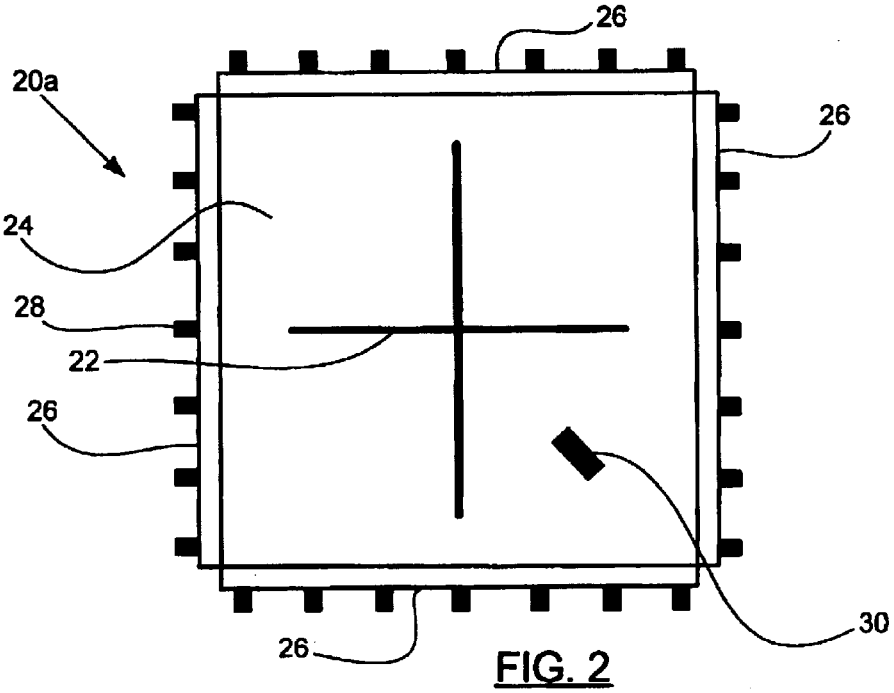
FIG. 2 is a plan view of a crossed-slot antenna according to the present invention.

Referring now to FIG. 2, a crossed-slot antenna 20*a* includes a crossed-slot 22 that is etched or stamped into a sheet of metal 24. The sheet of metal 24 may be constructed of any suitable conducting material. The conducting material can be copper, brass, or steel, although other conducting materials can be used. Sidewalls 26 are integrally formed with the sheet of metal 24. Additionally, mounting tabs 28 are integrally formed with the sidewalls 26. A three-sided feed structure 30 is etched or stamped in the surrounding metal sheet 24. The sidewalls 26 and feed structure 30 may be scored to facilitate bending. The antenna 20*a* may be plated with a suitable material, such as tin or solder to allow the antenna to be mated with a printed circuit board during fabrication.

Figure 3:
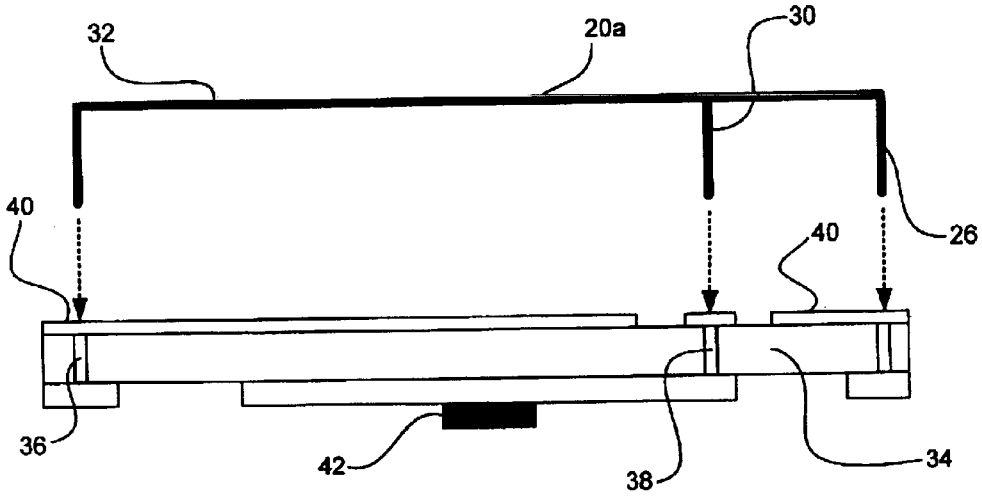
FIG. 3 is a side cross-sectional assembly view of the crossed-slot antenna of FIG. 2.

Referring now to FIG. 3, the sidewalls 26 are formed into a rectangular box 32. The feed structure 30 extends in a perpendicular direction from the plane of the antenna 20*a*. The antenna 20*a* is joined with a printed circuit board 34. The perimeter of the circuit board 34 is lined with metal-plated mounting apertures 36 that align with the mounting tabs 28 of the sidewalls 26. A feed point aperture 38 aligns with the feed structure 30. The antenna 20*a* is aligned with the printed circuit board 34 due to the mating of the mounting tabs 28 and the feed structure 30 with the corresponding apertures on the circuit board 34.

A ground plane 40 made of a conducting material is attached to a side of the circuit board 34. The metal forming the ground plane 40 is preferably interrupted only by the feed point aperture 38. A receiver circuit 42 mounted on the circuit board 34 shares the ground plane 40 with the antenna 20*a*. The feed structure 30, which communicates with the circuit board 34 via the feed point aperture 38, acts as the input from the antenna 20*a* to the receiver circuit 42.

Using the above-described method, the circuit board 34 may be a simple, two-layer circuit board that is constructed from high loss, low cost material. The amplifiers, filters, and other circuit elements of the receiver circuit 42 are attached to the underside of the circuit board 34 using surface mount techniques. The antenna 20*a* is attached to the circuit board 34 by soldering the mounting tabs 28 to mounting apertures 36.

Figure 4:
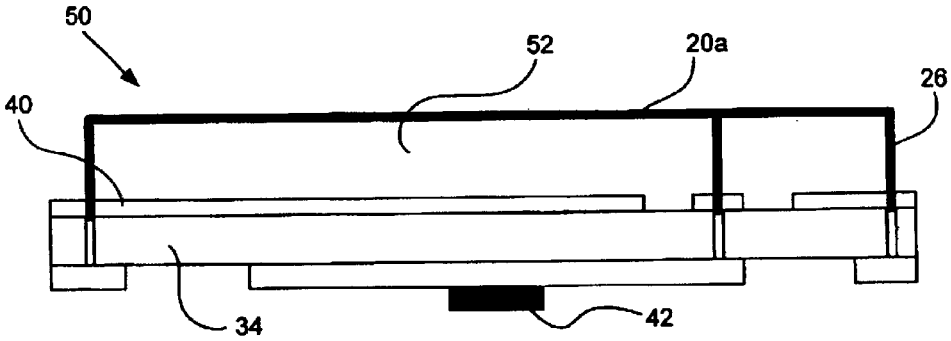
FIG. 4 is a side cross-sectional view of the crossed-slot antenna of FIG. 2.

Referring now to FIG. 4, the completed antenna structure 50 includes the circuit board 34, the shared ground plane 40, and the antenna 20*a*. The antenna 20*a* and the ground plane 40 form an air-filled cavity 52. This design has extremely low RF loss because the cavity 52 is filled with air. The only loss in the antenna structure 50 is due to ohmic losses in the metal of the sidewalls 26. Thus, the antenna structure 50 does not necessitate the use of low-loss dielectric materials as conventional designs require. If the cavity 52 is filled with a dielectric material, the material must have extremely low loss due to the high electric fields that are present in the resonant cavity 52. The thickness of the cavity 52 determines the bandwidth of the antenna 20*a*. As can be appreciated, low loss is not required for the remainder of the receiver circuit 42 because a signal received by the antenna 20*a* is sufficiently strong. Additionally, the design requires only a single ground plane 40, which serves as both one wall of the cavity 52 and a ground plane for the receiver circuit 42. Therefore, a single layer, double-sided circuit board 34 may be used, rather than an expensive multilayer board.

Figure 5:
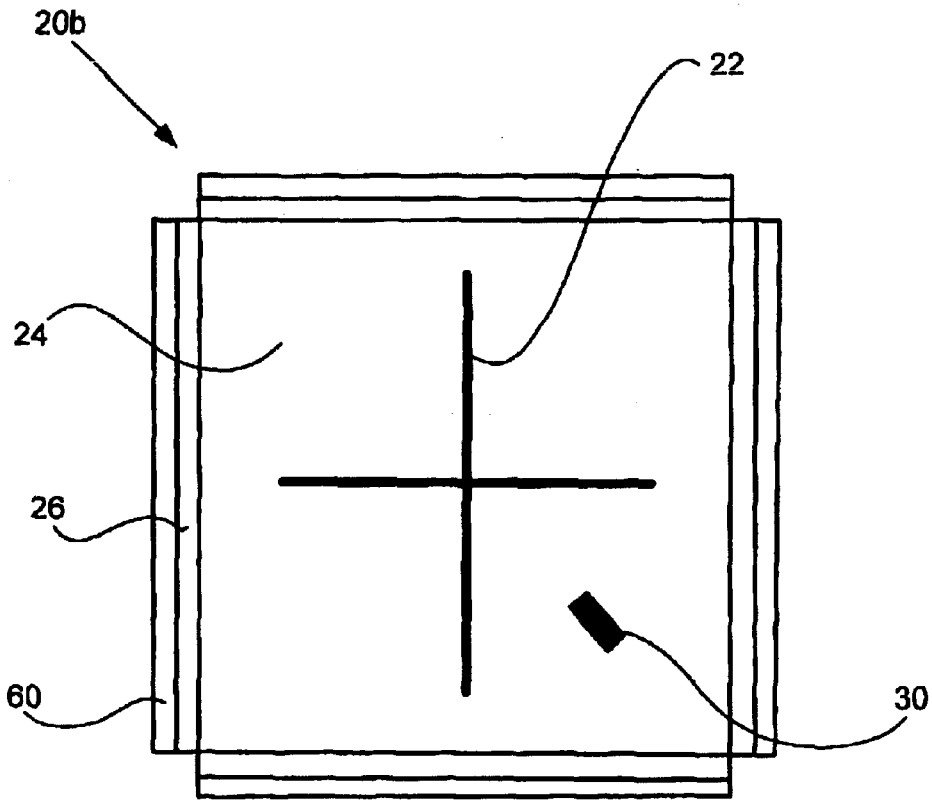
FIG. 5 is a plan view of an alternative crossed-slot antenna.

Referring now to FIG. 5, an alternative embodiment of the sheet of metal 24 used to construct the antenna 20*b* is shown. Additional bands of metal 60 are integrally formed with the sidewalls 26. The bands 60 and sidewalls 26 may be formed as a uniform structure that is subsequently scored. The bands 60 replace the mounting tabs 28 in FIG. 2. The crossed-slot aperture 22 and the feed structure 30 are etched or stamped into the sheet of metal 24 as previously described.

Figure 6:
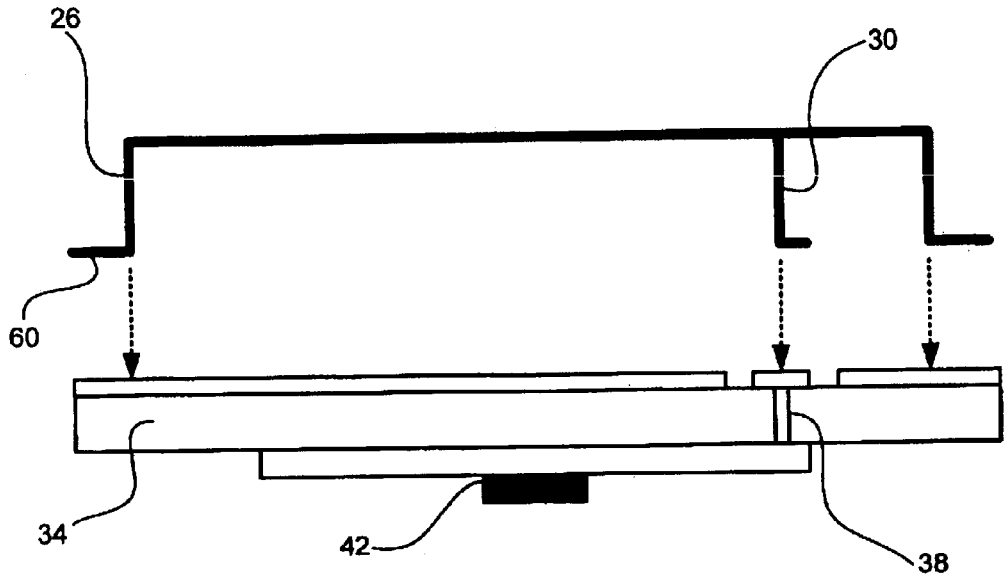
FIG. 6 is a side cross-sectional assembly view of the crossed-slot antenna of FIG. 5.

Referring now to FIG. 6, the sidewalls 26 are bent at a ninety-degree angle to the plane of the antenna 20*b*. The bands 60 are bent at a ninety-degree angle to the sidewalls. The feed structure 30 is bent in a similar manner. This embodiment does not include mounting apertures 36 on the circuit board 34. A feed point aperture 38 is provided for the feed structure 30 to supply the signal to the receiver circuit 42.

Figure 7:
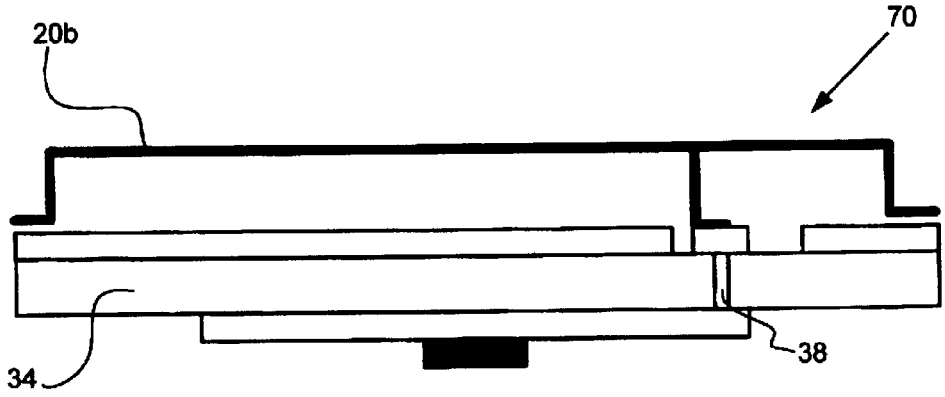
FIG. 7 is a cross-sectional view of the alternative crossed-slot antenna of FIG. 5.

The antenna 20*b* is mounted to the circuit board 34 to form the completed alternative structure 70 as shown in FIG. 7. Because the circuit board 34 provides a single aperture 38 for attachment purposes, the alternative structure 70 is a simpler, less expensive design. The antenna 20*b* is aligned with the circuit board 34 using an alternative method due to the absence of mounting tabs 28 and mounting apertures 36. While this complicates the fabrication process, alternative alignment methods are well known to those skilled in the art of surface mounting techniques. The antenna 20*b* may be attached to the circuit board 34 using soldering paste or other attachment methods.

Figure 8A:
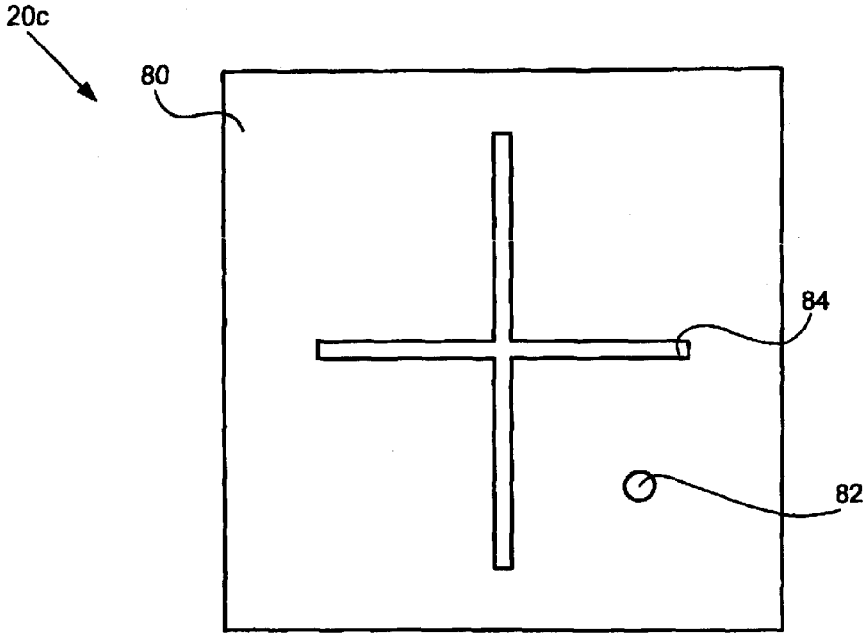
FIG. 8A is a plan view of a crossed-slot antenna formed with injection molding.
Figure 8B:
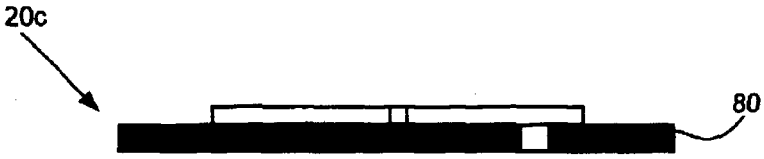
FIG. 8B is a cross-sectional view of the crossed-slot antenna of FIG. 8A.

Referring now to FIG. 8, a crossed-slot antenna 20*c* that is produced using injection molding is shown. A rectangular plastic block 80 is formed with a feed aperture 82 provided as a feed point. A cross pattern 84 that is integrally formed on the surface of the plastic block 80 acts as a crossed-slot. The block 80 and cross pattern 84 may be formed of a variety of suitable, low-loss plastics, including but not limited to acrylic or lucite plastics.

Figure 9A:
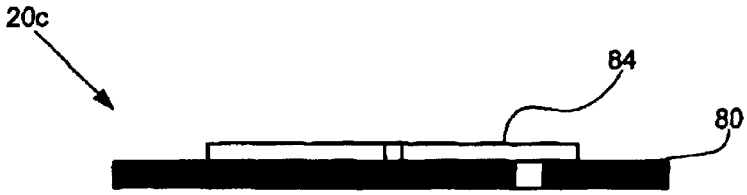
FIG. 9A is a cross-sectional view of a metal plated crossed-slot antenna.
Figure 9B:
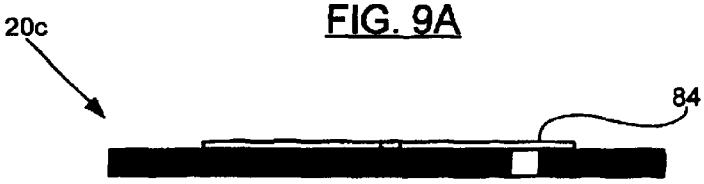
FIG. 9B is a cross-sectional view of a planed crossed-slot antenna.

Referring now to FIG. 9, the plastic block 80 is plated with copper or other suitable metal to form the antenna 20*c*. The structure may be further plated with tin for weather protection purposes. The antenna 20*c* is then passed through a planing machine or other device, which removes the top surface of the copper plating and leaves the crossed-slot pattern 84 exposed. The antenna 20*c* is attached to a circuit board containing a receiver circuit as described previously. The feed aperture 82 is filled with copper during the plating process, which acts as a feed structure for the receiver circuit.

The plastic block 80 acts as the cavity as described in previous embodiments. The antenna 20*c* has a higher dielectric loss due to the plastic material filling the cavity. Additionally, antenna 20*c* is more expensive to produce than previous embodiments discussed herein. However, antenna 20*c* may be advantageous in applications wherein size is an important factor. Antenna 20*c* may be constructed smaller than embodiments with an air-filled cavity 52. Nonetheless, antenna 20*c* is less expensive to produce than conventional methods.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method for fabricating a crossed-slot antenna comprising:

forming a crossed-slot and a feed structure in a sheet of metal;

forming sidewalls on the sheet of metal; and attaching the sidewalls to a circuit board, wherein the sheet of metal, the sidewalls, and the circuit board define an air-filled cavity.

2. The method of claim 1 further wherein the crossed-slot includes a first slot that is perpendicular to a second slot.

3. The method of claim 2 wherein the first slot has a different length than the second slot.

4. The method of claim 1 wherein the step of forming the crossed-slot includes etching the crossed-slot into the sheet of metal.

5. The method of claim 1 wherein the step of forming the crossed-slot includes stamping the crossed-slot into the sheet of metal.

6. The method of claim 1 wherein the step of forming the feed structure includes etching the feed structure into the sheet of metal.

7. The method of claim 1 wherein the step of forming the feed structure includes stamping the feed structure into the sheet of metal.

8. The method of claim 1 wherein the sheet of metal is scored to facilitate bending of the sidewalls.

9. The method of claim 8 further comprising forming bands on the sidewalls perpendicular to the sidewalls.

10. The method of claim 9 further comprising attaching the bands to the circuit board.

11. The method of claim 10 wherein the bands are soldered to the circuit board.

12. The method of claim 9 wherein the bands are integrally formed with the sidewalls and scored to facilitate bending of the bands relative to the sidewalls.

13. The method of claim 1 further comprising bending the feed structure perpendicular to the sheet of metal.

14. The method of claim 1 further comprising:

forming tabs on the sidewalls that align with apertures on the circuit board; and mating the tabs to the apertures.

15. The method of claim 14 wherein the step of attaching the circuit board includes mating the feed structure to a feed point on the circuit board.

16. The method of claim 1 further comprising attaching a ground plane to the circuit board.

17. The method of claim 1 further comprising attaching an antenna receiver circuit to the circuit board.

18. A method for fabricating a crossed-slot antenna with a solid cavity comprising:

creating first and second intersecting ridges on one side of a sheet of plastic;

forming a feed aperture in the sheet of plastic;

plating the sheet of plastic with metal; and removing the metal plating from the one side to expose the first ridge and the second ridge.

19. The method of claim 18 further comprising attaching the sheet of plastic to a circuit board.

20. The method of claim 19 wherein the sheet of plastic acts as a cavity defined by the circuit board and the metal plating.

21. The method of claim 18 wherein the sheet of plastic is acrylic.

22. The method of claim 18 wherein the sheet of plastic is lucite.

23. The method of claim 18 wherein the step of plating the sheet of plastic includes filling the feed aperture with metal plating.

24. The method of claim 18 further comprising plating the sheet of plastic with a second metal.

25. The method of claim 18 wherein the step of removing the metal plating includes planing the metal plating from the sheet of plastic.

26. A crossed-slot antenna having an air-filled cavity comprising:

an electrically conductive structure having a crossed-slot and a feed structure;

sidewalls integrally formed on the electrically conductive structure;

a circuit board attached to the sidewalls; and an air-filled cavity defined by the electrically conductive structure, the sidewalls, and the circuit board.

27. The crossed-slot antenna of claim 26 wherein the crossed-slot includes a first slot that is perpendicular to a second slot.

28. The crossed-slot antenna of claim 27 wherein the first slot has a different length than the second slot.

29. The crossed-slot antenna of claim 26 wherein the sidewalls are scored to enable bending of the sidewalls relative to the electrically conductive structure.

30. The crossed-slot antenna of claim 26 wherein the feed structure is integrally formed with the electrically conductive structure.

31. The crossed-slot antenna of claim 30 wherein the feed structure is scored to facilitate bending of the feed structure relative to the electrically conductive structure.

32. The crossed-slot antenna of claim 26 wherein at least one of the sidewalls and the feed structure is perpendicular to a plane defined by the electrically conductive structure.

33. The crossed-slot antenna of claim 26 further comprising:

tabs integrally formed with the sidewalls; and apertures formed on the circuit board, wherein the tabs and the apertures align the electrically conductive structure to the circuit board.

34. The crossed-slot antenna of claim 26 wherein the feed structure insertably connects to a feed point on the circuit board.

35. The crossed-slot antenna of claim 26 further comprising a ground plane located between the electrically conductive structure and the circuit board.

36. The crossed-slot antenna of claim 26 further comprising a receiver circuit.

37. A crossed-slot antenna with a solid cavity comprising:

a sheet of plastic plated with a conductive material;

first and second intersecting ridges formed on the sheet of plastic;

a feed aperture formed in the sheet of plastic; and a circuit board attached to the sheet of plastic, wherein the sheet of plastic is a cavity defined by the conductive material and the circuit board.

38. The crossed-slot antenna of claim 37 wherein the sheet of plastic is acrylic.

39. The crossed-slot antenna of claim 37 wherein the sheet of plastic is lucite.

40. The crossed-slot antenna of claim 37 wherein the feed aperture is filled with the conductive material.

41. The crossed-slot antenna of claim 37 wherein the sheet of plastic is further plated with a second conductive material.

* * * * *